United States Patent [19]

Nakamura

[11] Patent Number: 4,903,627

[45] Date of Patent: Feb. 27, 1990

[54] STEERING HANDLE DEVICE FOR JET-PROPELLED SMALL-SIZED BOATS

[76] Inventor: Yukio Nakamura, 5-6, 1-Chome, Tengachayakita, Nishinari-Ku, Osaka-Shi, Japan

[21] Appl. No.: 264,111

[22] Filed: Oct. 28, 1988

[51] Int. Cl.[4] ..... B63B 35/86

[52] U.S. Cl. ..... 114/270; 74/551.3; 114/144 R

[58] Field of Search ..... 114/270, 144 R; 440/40; 74/480 B, 551.1, 551.3, 551.6, 551.7; 244/234; 16/111 R, 111 A, 112

[56] References Cited

U.S. PATENT DOCUMENTS

| | | | |
|---|---|---|---|
| 1,068,158 | 7/1913 | Noack | 74/551.7 |
| 3,810,440 | 5/1974 | Johnson, Jr. | 114/144 R |
| 4,023,436 | 5/1977 | Dodge | 74/551.3 |
| 4,745,872 | 5/1988 | Nakamura | 114/270 |
| 4,748,928 | 6/1988 | Nakamura | 114/144 R |

OTHER PUBLICATIONS

Kawasaki, JS550-A, Jet Ski Watercraft Parts Catalog, Kawasaki Heavy Industries, Ltd., 1984.

Jetski World, vol. 1, 1987.

*Primary Examiner*—Sherman D. Basinger

*Attorney, Agent, or Firm*—Armstrong, Nikaido, Marmelstein, Kubovcik & Murray

[57] ABSTRACT

The present invention relates to a steering handle device for small jet-propelled boats in which the stern of the boat is used as a floor deck on which the rider stands, and the engine is mounted on the front of the floor deck. A handle post is pivotally connected to the bow of the boat by a horizontal shaft. A base board for attaching the handle bar is integrated with the rear or upper end of the handle post overhanging the floor deck, and an attaching plate for the handle bar is pivotally connected to the base board by a vertical shaft. The rider steers using the handle bar and by changing the position at which he/she applies foot pressure to the boat. The steering handle device is characterized by the handle bar being constructed substantially in a H-shape as seen from a front view. The handle bar assembly consists of a handle bar body horizontally extending transversely of the boat, and a pair of grips vertically extending from the opposite ends of the handle bar body. At least the middle portion of the handle bar body is used as a straight pivot bar portion orthogonal to the vertical shaft. The pivot bar portion is assembled to a grasping bracket and is rotatable around its own longitudinal axis. As such, the tilt angle of the grips is adjustable by the rider.

1 Claim, 8 Drawing Sheets

STEERING HANDLE DEVICE FOR JET-PROPELLED SMALL-SIZED BOATS

BACKGROUND OF THE INVENTION

Generally, in jet-propelled small-sized boats which glide over water surface, a single person rides the boat in a standing posture on the floor deck of the boat with his hands gripping the handle bars to rotate them for steering so as to control a steering cable extending from a handle post via the boat interior to the stern to swing the steering nozzle of the jet propelling device (water jet pump) for steering the boat.

During riding, the rider intentionally changes the position of application (position of the center of gravity of the boat) of the foot pressure (rider's body weight) on the floor deck of the boat, thus causing the boat not only to glide over water surface in a curve but also to jump above water surface or, reversely, to dive. In this manner, the rider steers the boat to change its posture as desired while enjoying the high technique required to make such change or competing in such technique, a fact attributable to the increasing popularity of this type of boats particularly among the young.

In a conventional boat of this type, however, as is clear from FIGS. 9 through 11, a handle post 1 is pivotally connected at its front or lower end to the boat a by a horizontal shaft 2 to allow its rear or upper end to swing in arcuate movement. A handle bar attaching plate 5 pivotally connected through a vertical shaft 4 to a base board 3 belonging to said rear or upper end which swing in such arcuate movement is integrated with a handle bar b at the middle as by welding; therefore, when the level of the upper or rear end of the handle post increases as the arcuate movement of said handle post 1 proceeds, the rider has to shift his position toward the front of the floor deck 6 or, reversely, if the level of the handle bar b decreases, he is forced to stand at a position nearer to the rear of the floor deck 6.

Thus, the standing position of the rider is consequently influenced by such changes in the level of the handle post 1, and the steering operation is limited in changing the position at which the foot pressure is applied to the boat. As a result, it becomes difficult to steer the boat a to change its posture, as desired. Further, the capability of the boat to cope with the rider's physical build and steering technique which vary from rider to rider is degraded.

In this connection, according to U.S. Pat. No. 4,745,872 previously proposed by the present inventor, structurally, the attaching bracket A of the handle bar 16 is divided into a front bracket 17 and a rear bracket 21. Since the position at which the rear bracket 21 is connected to the front bracket 17 is adjustable, the rear bracket 21 can be slid for adjustment to the rider's physical build and steering technique which vary from rider to rider; thus, the disclosed arrangement is advantageous in that the aforesaid problem has been solved in this manner.

However, in the case of the invention of U.S. Pat. No. 4,745,872, a pair of grips 27 at the handle bar 17 are integrated with the opposed ends of the straight extensions of said bar and extend substantially horizontally in rearwardly diverging form as seen in a plan view. Therefore, the rider assumes a steering posture in which the backs of the hands holding the grips 27 are turned upward, with the armpits opened.

As a result, the foot pressure resulting from the rider's body weight cannot be applied to the boat 10 effectively and rationally from the standpoint of human engineering, and it is also difficult to steer the boat in a stabilized manner while exerting an effective resistance to the force which tends to throw away the rider's body during the revolving of the boat 10. It should be said that the disclosed arrangement leaves room for improvement in the feeling of integration between the rider and the boat and is difficult to operate.

Further, since the handle post 13 is swung around the axis of the horizontal shaft 14 at its front or lower end, its tilt angle with respect to the floor deck 11 also varies. Since the handle bar 16 is rigidly attached to the rear or upper end of the handle post through the base board 15 and the attaching bracket A, the posture and the direction of extension of the grips 27 on the handle bar 16 also vary, and there will arise another problem that the rider fails to stably hold the grips without adversely affecting his steering posture. And such problems likewise arise in the conventional product shown in FIGS. 9 through 11.

SUMMARY OF THE INVENTION

The present invention has been accomplished to solve such problems and a first object of the invention is to provide an arrangement using a handle bar which comprises a handle bar body horizontally extending transversely of the boat, and a pair of grips extending vertically from and integrated with the opposite ends of said handle bar body so that said handle bar, when seen in a plan view, is substantially H-shaped, whereby the rider is kept in a steering posture in which the backs of the rider's hands holding said grips are directed sideways, with his armpits tightly closed, enabling the rider to steer the boat in a stable manner while preventing his body from being shaken during the revolving of the boat, also enabling the rider to apply the foot pressure resulting from his body weight to the boat without loss and rationally from the standpoint of human engineering, the steerability being thus improved.

A second object of the invention is to provide an arrangement wherein a handle bar attaching base board is integrated with the rear or upper end of a handle post adapted to swing around the axis of a horizontal shaft by which the handle post is attached to the boat, said base board having a handle bar attaching plate pivotally connected thereto by a vertical shaft, the rear end of said attaching plate having fixed thereto a grasping bracket for receiving the pivot bar portion of said handle bar, said grasping bracket having the pivot bar portion assembled thereto so that it is rotatable around its own longitudinal axis, the tilt angle of the grips with respect to the horizontal plane of the handle bar body being adjustable, whereby anyone can use the boat in such a manner that he is allowed to stand at a desired position on the boat while stably holding the grips irrespective of such factors as a change in the level of the upper or rear end of the handle post, a change in the tilt angle of the handle post with respect to the plane of the floor deck, a difference in the size of the rider's physical build and a difference in the personal level of steering technique, and wherein when the position at which the foot pressure is applied to the boat is to be intentionally changed, this can be effected smoothly, accurately and efficiently without involving physical limitations or forced irrational steering posture.

The tilt angle of the grips with respect to the horizontal plane of the handle bar body is adjusted to a change in the level of the rear or upper end at the handle post or a change in the tilt angle formed between the handle post and the plane of the floor deck, whereby anyone can steer the boat in the most suitable steering posture and the foot pressure can be effectively applied to the boat at a desired position. Further, the feeling of integration between the rider and the boat can also be improved.

A third object of the invention is to provide an arrangement wherein the handle bar attaching plate is in the form of an assembly comprising a pair of plates, i.e., a front plate pivotally connected to the base board by a vertical shaft, and a rear plate assembled to said front plate in such a manner as to be adjustable longitudinally of said front plate, and wherein said; handle bar grasping bracket is fixedly attached to the rear end of said rear plate, thereby further improving the arrangement provided by said second object.

Other objects of the present invention will become more apparent from the detailed description of embodiments when taken in conjunction with the accompanying drawings.

DESCRIPTION OF THE PREFERRED EMBODIMENTS

Figure 1:
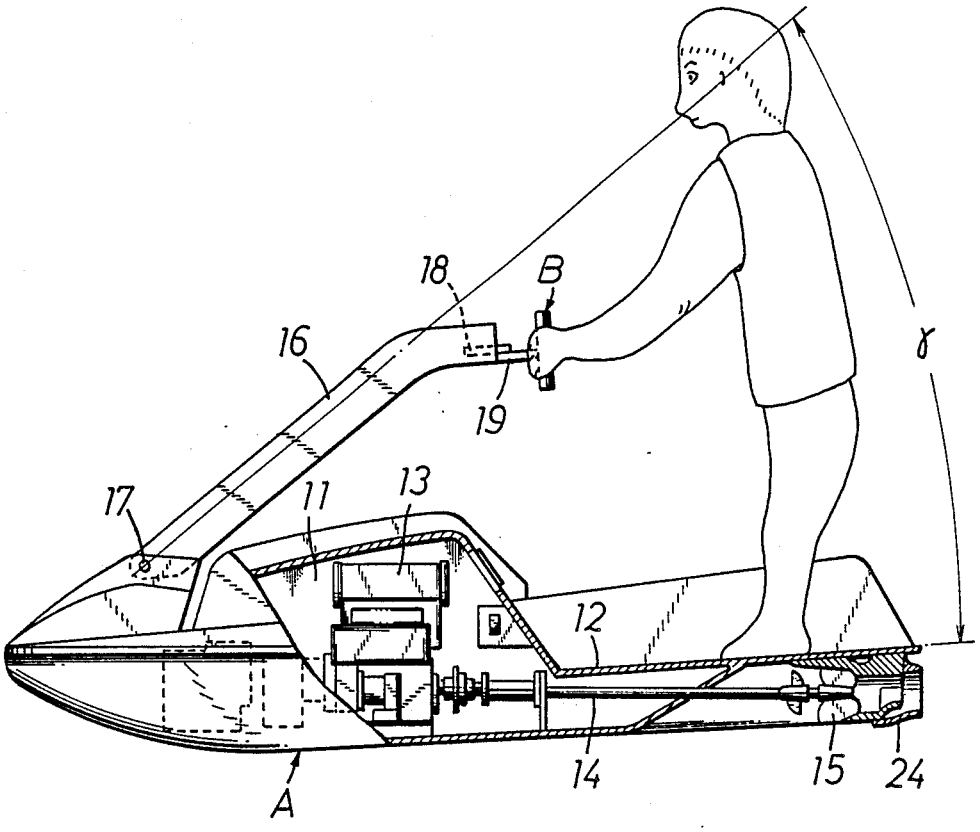
FIG. 1 is a complete schematic side view, partly broken away, of a jet-propelled small-sized boat according to the present invention.

The concrete arrangement of the present invention will now be described in detail with reference to the accompanying drawings. FIG. 1 schematically shows a jet-propelled small-sized boat in its entirety according to the invention. The character A generally denotes a boat built in a hollow sealed type of float construction from fiber-reinforced plastic (FRP). The front half of the boat has an engine room 11 defined therein and the rear half is adapted for use as a floor deck 12 on which the rider stands.

The numeral 13 denotes an engine installed in the engine room 11, whereby a jet-propelling device (water jet pump) 15 is driven through a propeller shaft 14, thus imparting a propelling force to the boat A. The numeral 16 denotes a handle post pivotally connected to the bow of the boat by a horizontal shaft 17 so that it is swingable, and the rear or upper end of said handle post overhanging the floor deck 12 has a handle bar attaching base board 18 integrally fixed thereto in a lining fashion.

A steering handle device which follows is attached to !' the base board. In FIGS. 2 through 6 showing said steering handle device in enlarged views, the numeral 19 denotes an attaching plate for a handle bar B, said attaching plate comprising a pair of plates, i.e., a front plate 20 and a rear plate 21. The front plate 20 is applied to the lower side of said base board 18 and pivotally connected thereto by a vertical shaft 22 so that it is revolvable around the axis of said vertical shaft 22.

Figure 2:
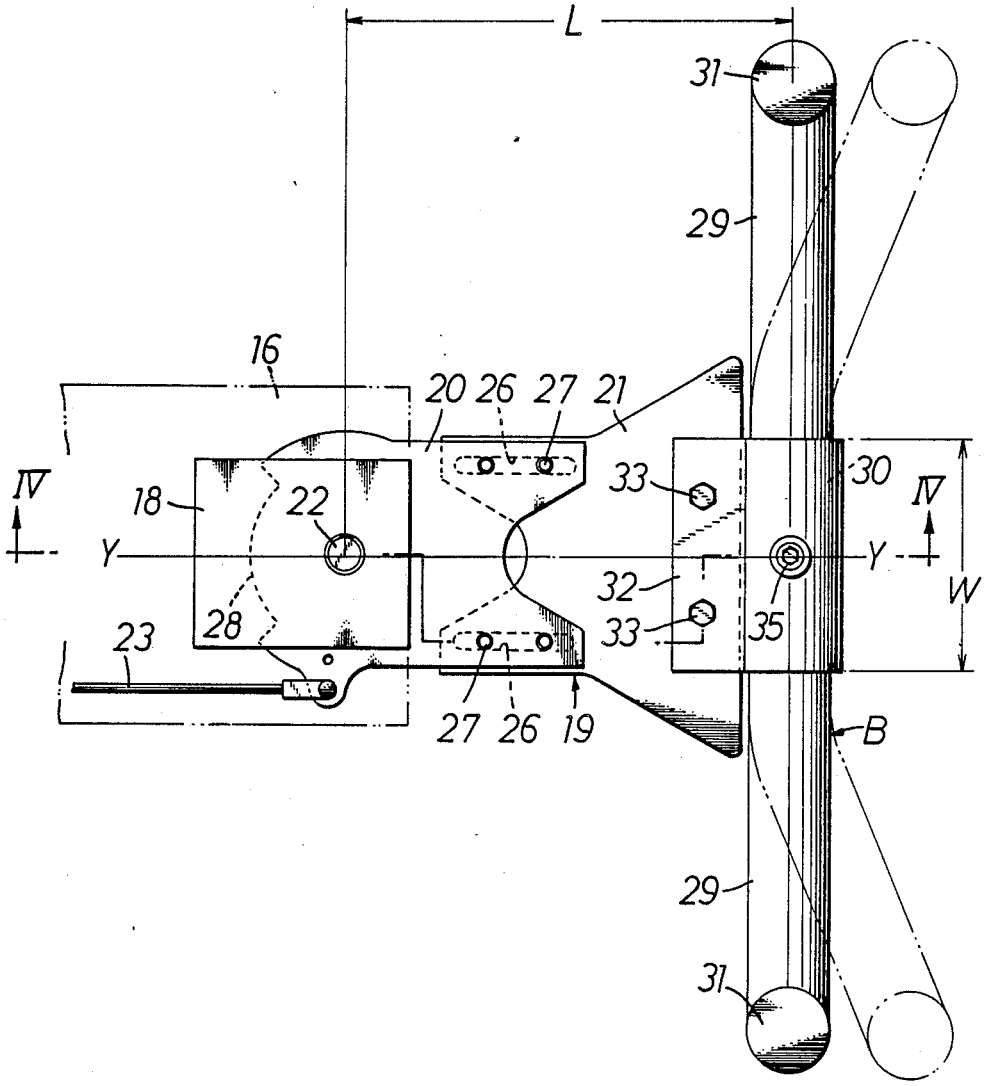
FIG. 2 is an enlarged plan view of a steering handle device extracted therefrom.
Figure 3:
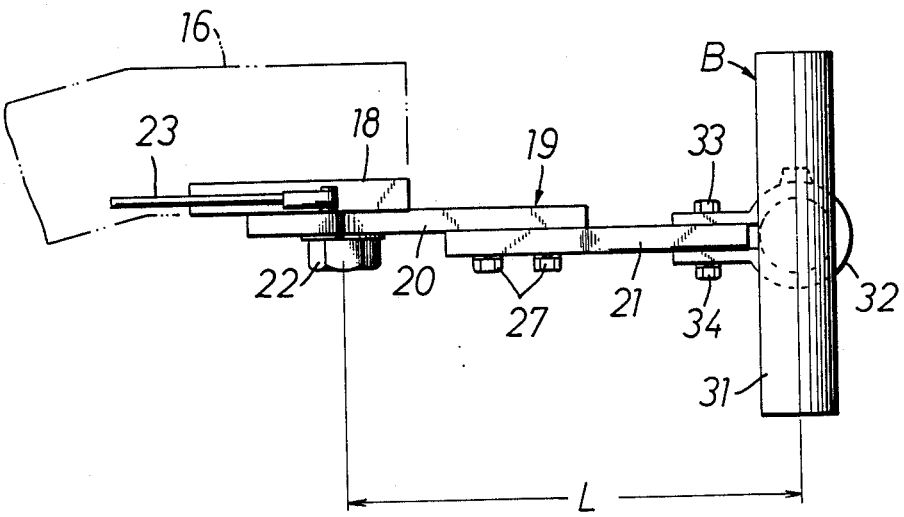
FIG. 3 is a side view of the handle device.

The vertical shaft 22 lies on the travel center line Y—Y of the boat A, while the initial end of a steering cable 23 is attached to the front plate 20 at an offset point deviated laterally to the left or right side, as shown in FIGS. 2 and 3. It goes without saying that the terminal end of said steering cable 23 extends rearward through the handle post 16 and the boat A and is connected to a steering nozzle 24 belonging to the jet propelling device 15 in the stern.

The numeral 25 denotes a plurality of pairs of adjusting threaded holes in the rear portion of the front plate 20, two holes one on each side forming a pair, and a pair of longitudinally extending elongated slide guide openings 26 associated therewith are formed on opposite sides in the front portion of the rear plate 21. Thus, in joining the rear plate 21 to the lower side of the front plate 20, the rear plate 21 can be longitudinally slid back and forth and then a plurality of fixing bolts 27 can be driven into the adjusting threaded holes 25 from the elongated slide guide openings 26, whereby the pair of front and rear plates 20 and 21 can be put together.

In other words, it is arranged that the handle bar B belonging to the attaching plate 19 can be adjusted and set in advance in relation to the length L measured from said vertical shaft 22 toward the rear (i.e., to the attaching position for the handle bar). Thus, so long as this purpose can be accomplished, this arrangement may be reversed by forming said elongated slide guide openings 26 in the front plate 20 while forming said adjusting threaded holes 25 in the rear plate 21.

In either case, since the attaching position for the handle bar B can be adjusted longitudinally of the boat A and since the rear or upper end of the handle post 16 is swingable around the axis of said horizontal shaft 17, the rider's physical build and steering technique which vary from rider to rider can be coped with and the position at which foot pressure is applied to the boat A can be changed as desired by any rider.

The numeral 28 denotes a notch for limiting to a predetermined value the angle of revolution of the attaching plate 19 around the axis of the vertical shaft 22, said notch being in the form of an arc as shown in FIG. 2 and formed in the front edge of the front plate 20. A pin adapted to engage said limiting notch 28 projects from the base board 18; this pin is omitted from illustration.

The handle bar B mentioned previously is substantially H-shaped as shown in FIG. 5 and is formed of a round pipe or bar of metal. More particularly, the numeral 29 denotes a handle bar body horizontally extending transversely of the boat A. At least a middle portion of given length W thereof serves as a pivot bar portion 30 in the form of a straight bar exactly orthogonal to the vertical shaft 22.

In this connection, although the entire handle bar body 29 including the middle pivot bar 30 is shown FIG. 2 in the form of a straight bar exactly orthogonal to the vertical shaft 22, the right and left portions of the handle bar body 20 excluding the pivot bar portion 30 may be gently bent rearward in the same horizontal plane as that of the pivot bar portion 30.

The numeral 31 denotes a pair of grips integrated with the opposite ends of the handle bar body 29 by welding or other fixing means, said grips vertically extending in orthogonal relation to the pivot bar portion 30. Therefore, when seen in the longitudinal direction, the handle bar B is in substantially H-shaped form consisting of the handle bar body 29 and the pair of grips 31. The middle pivot bar portion 30 of the handle bar body 29 is held in a grasping bracket 32 which is attached to the rear plate 21 in said attaching plate 19.

Figure 4:
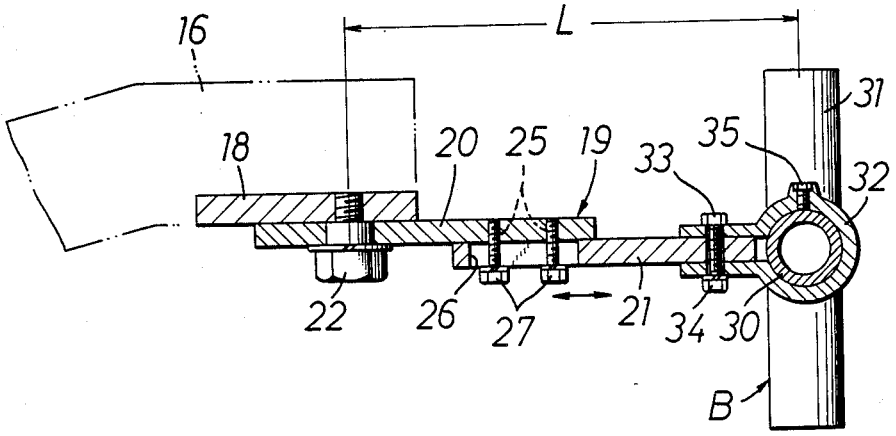
FIG. 4 is a sectional view taken along the line IV—IV in FIG. 2.
Figure 6:
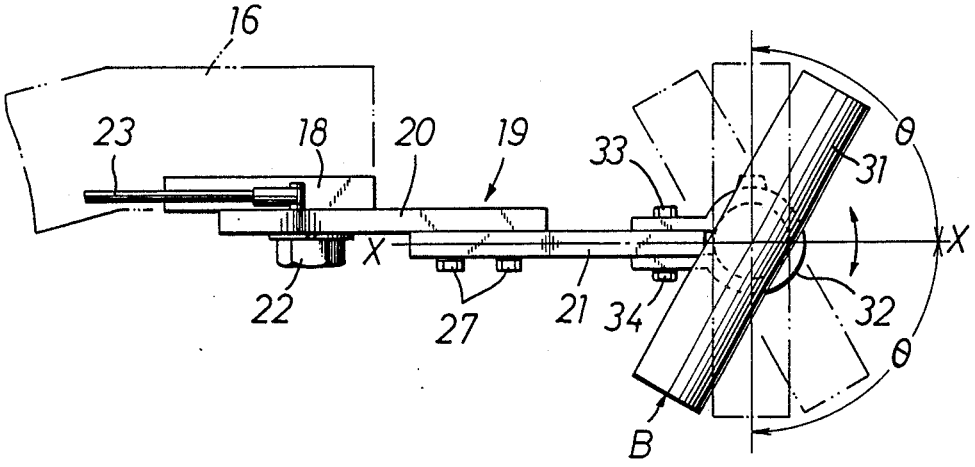
FIG. 6 is a side view showing how the angle of a grip with respect to the horizontal plane of a handle bar body is changed.
Figure 5:
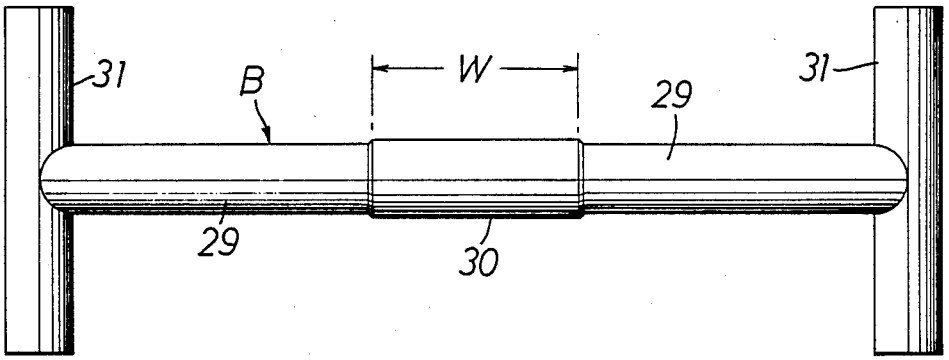
FIG. 5 is a front view showing a handle bar.

As is clear from FIG. 4, the grasping bracket 32 is formed of a single metal plate half-folded, and with the opposed free ends thereof holding the rear plate 21 therebetween, the grasping bracket 32 is removably connected to the rear plate 21 by a plurality of bolts 33 and nuts 34 associated therewith. Prior to tightening the nuts 34 on the bolts 33, the pivot bar portion 30 of the handle bar body extending through the rear bight portion of the grasping bracket 32 is turned around its own horizontal longitudinal axis to simultaneously tilt the pair of grips 31 forward or rear ward from their upright position, as shown in FIG. 6. In this manner, the tilt angle $\theta$ of the grips 31 with respect to the horizontal plane X—X of the handle bar body 29 can be adjusted and set in advance.

Therefore, even if the level of the rear or upper end of the handle post varies or the tilt angle $\gamma$ of the handle post 16 with respect to the plane of the floor deck 12 varies, the handle bar body 29 can be correspondingly rotated to adjust said tilt angle $\theta$ of the grips 31; in this manner, the grips 31 can always be set so that they are easy to hold.

Subsequently to adjusting the tilt angle $\theta$ to a desired value, the nuts 34 on the bolts 33 are tightened, whereby the pivot bar portion 30 of the handle bar body 29 is grasped in the clamped state by the grasping bracket 32. Although there would be no danger of " producing a play which disturbs said angle $\theta$, to strengthen the positioning, it is preferable, as shown in FIGS. 2 and 4, to drive a set screw 35 into a threaded hole in the grasping bracket 32 until its front end engages the pivot bar portion 30 to fix the latter.

Figure 7:
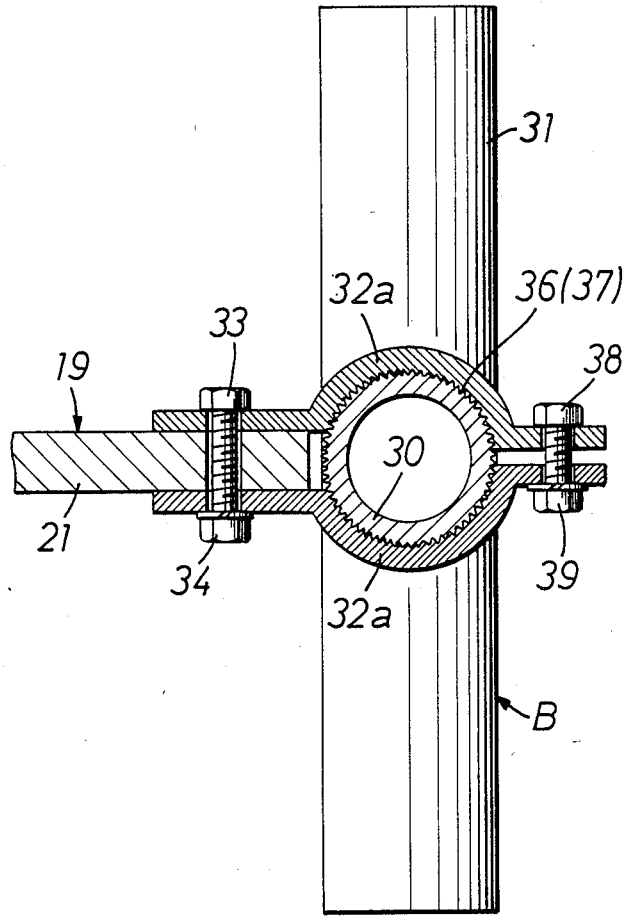
FIGS. 7 and 8 are partial enlarged side views of two modified embodiments showing the manner of attaching the handle bar.
Figure 8:
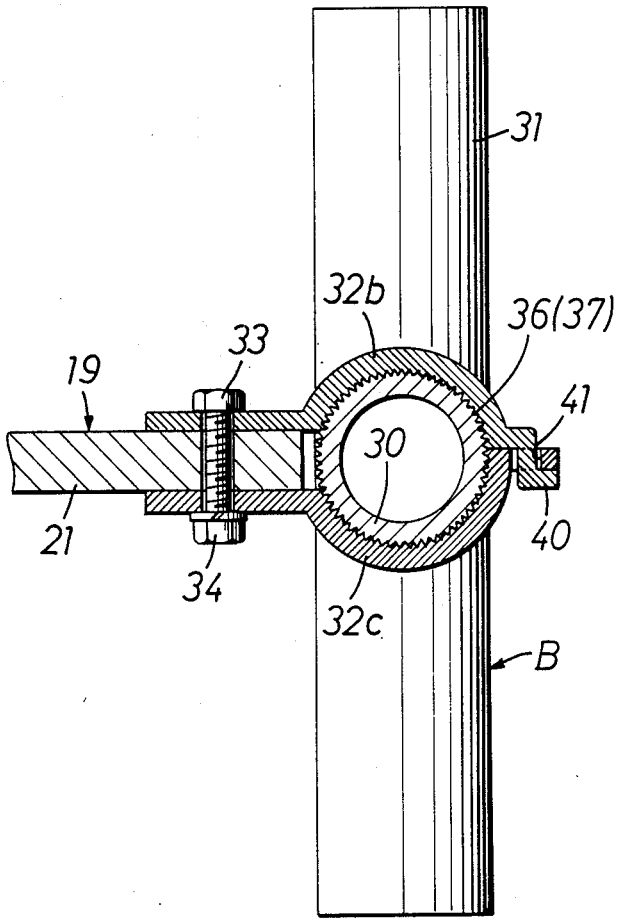
Figure 10:
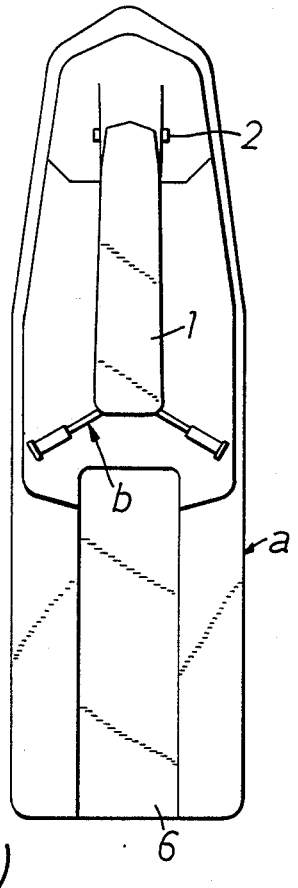
Fig.10 (Prior Art)
FIGS. 9 and 10 are a side view and a plan view, schematically showing a conventional jet-propelled small-sized boat in its entirety.
Figure 9:
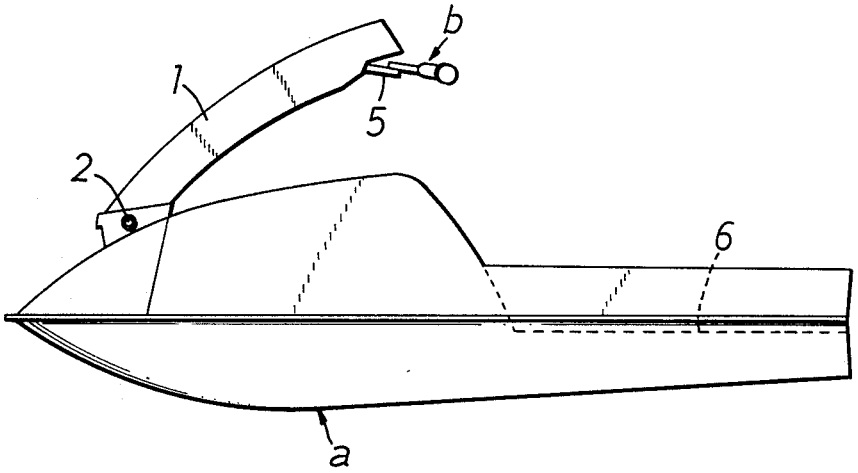
Fig.9 (Prior Art)
Figure 11:
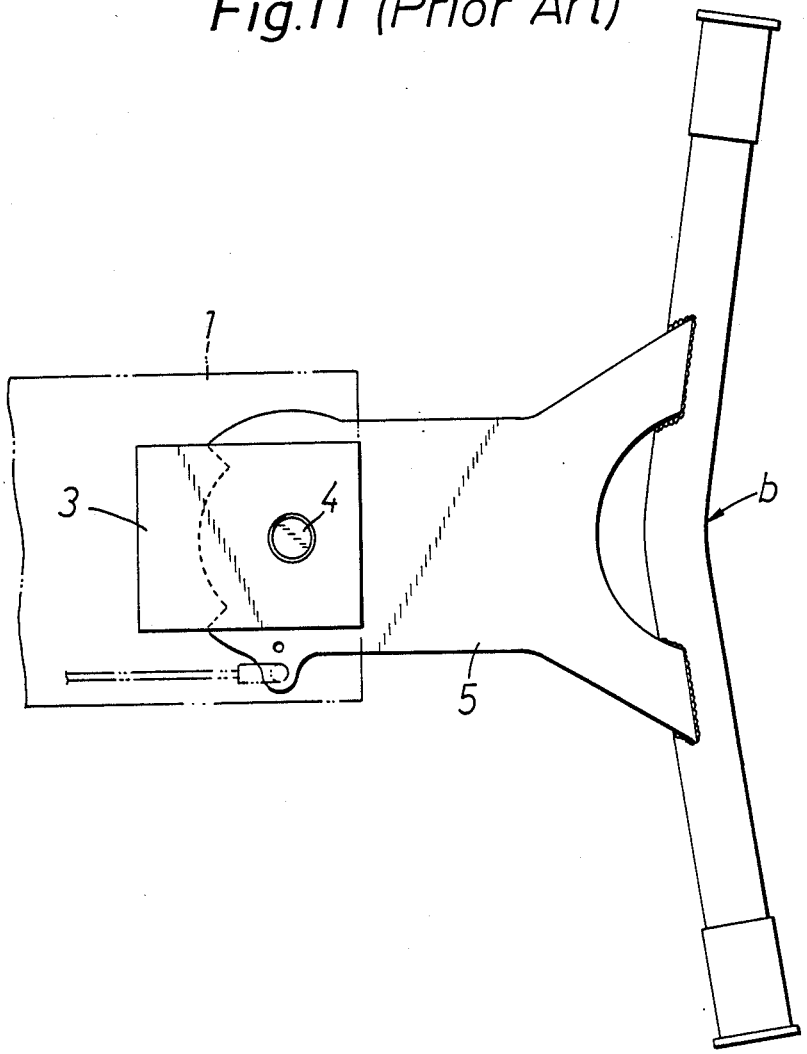
Fig.11 (Prior Art)
FIG. 11 is an enlarged plan view of a steering handle device extracted therefrom.

In the basic embodiment shown in FIGS. 2 through 6, the tilt angle $\theta$ has been set at an adjusted value by tightening the half-folded grasping bracket 32 by means of the bolts 33 and nuts 34 to thereby press the pivot bar portion 30 of the handle bar body 29 and, if necessary, driving the set screw 35; however, it is possible to use alternative arrangements as shown in FIGS. 7 and 8.

In a first modified embodiment shown in FIG. 7, a pair of upper and lower grasping brackets **32*a* opposed to each other in the form of split halves are prepared. The inner wall surface of each bight portion is formed with a recess and ridge combination 36 such as serrations, while a mating recess and ridge combination 37 is formed in the pivot bar portion 30*a* of the handle bar body 29**. Thus, the tilt angle $\theta$ can be adjusted and set to a desired value by means of engagement between said combinations.

In that case, the front ends of the grasping brackets **32*a* are joined to the rear plate 21 in the attaching plate 19 by the bolt 33 and nut 34, while the rear ends of the grasping brackets 32*a* are separably joined together by another fixing bolt 38 and nut 39**.

FIG. 8 shows a second modified embodiment which, as clearly shown, uses a pair of upper and lower grasping brackets **32*b* and 32*c* similar to the first modified embodiment. However, the bolt 38 and nut 39 for clamping the rear ends are omitted and instead one of the rear ends of the grasping brackets 32*a* and 32*c* is formed with a hook 40 extending therefrom while a hole 41 for receiving said hook 40 is formed in the other of the rear ends of the grasping brackets 32*b* and 32*c*. Thus, the handle bar body 29 can be grasped and fixed by the grasping brackets 32*b* and 32*c* by releasably engaging said hook 40 and said receiving hole 41** with each other.

In addition, the rest of the arrangement of the second modified embodiment shown in FIG. 8 is substantially the same as in the first modified embodiment shown in FIG. 7; therefore, the corresponding reference characters are entered and a detailed description is omitted.

At any rate, according to the steering handle device of the invention, the handle bar B is in substantially H-shaped form, as seen in a front view, comprising a handle bar body 29 horizontally extending transversely of the boat A, and a pair of grips 31 vertically extending from the opposite ends of said handle bar body 29. Therefore, the rider assumes a steering posture in which the backs of his hands holding the intersections between the grips 31 and the handle bar body 29 are turned sideways, as shown in FIG. 1, with his armpits closed tight.

As a result, the lifting and depressing of the handle post 16 by the wrists can be effected with less effort, and the foot pressure resulting from the rider's body weight can be rationally applied to the boat A without loss. And it is also possible to exert an effective resistance to the force produced during the revolving of the boat and tending to throw away the rider. The rider is allowed to safely steer the boat with the improved feeling of integration between the rider and the boat A.

Furthermore, the middle portion of the handle bar body 29 serves as a pivot bar portion 30 of given length W and is assembled to the grasping bracket 32 belonging to the attaching plate 19 so that it can be rotated around its own horizontal longitudinal axis. And the tilt angle $\theta$ of the grips 31 with respect to the horizontal plane X—X of the handle bar body 29 is adjustable, whereby anyone can use the boat in such a manner that he is allowed to stand at a desired position on the boat A while stably holding the grips by adjusting the tilt angle $\theta$ of the grips 31 to the most suitable value in accordance with such factors as a change in the level of the upper or rear end of the handle post 16, a change in the tilt angle $\gamma$ with respect to the plane of the floor deck 12, a difference in the size of the rider's physical build and a difference in the personal level of steering technique. Further, the position at which the foot pressure is applied to the boat A can be freely changed.

In that case, the attaching plate 19 for the handle bar B is made in the form of an assembly comprising a front plate 20 pivotally connected to the base board 18 by a vertical shaft 22, and a rear plate 21 longitudinally slidably and adjustably attached to said front plate 20. Thus, if the grasping bracket 32 for the handle bar B is fixed to the rear end of the rear plate 21, then the attaching position of the handle bar B itself can be longitudinally moved; therefore, the aforesaid effect can be further improved. Thus, the essential arrangement is relatively simple and parts can be mass-produced, a fact which is very useful.

What is claimed is:

1. A steering handle device for jet-propelled small-sized boats of the type in which the stern of the boat is adapted for use as a floor deck on which the rider stands, with an engine mounted on the front portion of said floor deck, said steering handle device comprising:

a handle post pivotally connected at its front end to the bow of the boat by a horizontal shaft so that a rear end of the handle post overhanging the deck is swingable;

a base board for attaching a handle bar integrated with the rear end of the handle post overhanging the floor deck; and an attaching plate for the handle bar pivotally connected to the base board by a vertical shaft, wherein the attaching plate for the handle bar is an assembly comprising a front plate pivotally connected to the base board by a vertical shaft, and a rear plate attached to the front plate so that it can be longitudinally slid for adjustment, said handle bar is constructed substantially in H-shape as seen in front view, with a handle bar body horizontally extending transversely of the boat, and a pair of grips vertically extending integrally from the opposite ends of said handle bar body, at least the middle portion of said handle bar body is adapted for use as a straight pivot bar portion of given length orthogonal to said vertical shaft, said pivot bar portion is assembled to a grasping bracket fixed to the rear end of said rear plate so that said pivot bar portion extends through said grasping bracket and is rotatable around its own longitudinal axis, whereby the position at which the handle bear itself is attached to said base board is set so that it can be longitudinally adjusted in advance, and the tilt angle of the grips with respect to the horizontal plane of the handle bar body is adjustable in advance.

* * * * *